United States Patent [19]

McLean, Jr. et al.

[11] Patent Number: 4,796,538

[45] Date of Patent: Jan. 10, 1989

[54] HOLD DOWN BAR FOR RAIL CAR HATCH COVERS

[76] Inventors: Ralph M. McLean, Jr., 1525 Hampton Hall Dr., Chesterfield, Mo. 63017; James C. Bates, 2247 N. Geyer Rd., St. Louis, Mo. 63131

[21] Appl. No.: 44,474

[22] Filed: May 1, 1987

[51] Int. Cl.[4] ..... B61D 39/00

[52] U.S. Cl. ..... 105/377; 49/394

[58] Field of Search ..... 105/377; 114/201 R; 49/394; 220/322–324

[56] References Cited

U.S. PATENT DOCUMENTS

| | | | |
|---|---|---|---|
| 2,647,473 | 8/1953 | Lunde | 105/377 |
| 3,664,270 | 5/1972 | Stark et al. | 105/377 |
| 4,362,118 | 12/1982 | Koch, Jr. et al. | 114/201 R |
| 4,378,742 | 4/1983 | Saylor et al. | 105/377 |
| 4,594,949 | 6/1986 | Kleykamp | 105/377 |
| 4,601,245 | 7/1986 | Kleykamp | 105/377 |
| 4,602,568 | 7/1986 | Kleykamp et al. | 105/377 |
| 4,602,569 | 7/1986 | Kleykamp | 105/377 |
| 4,684,418 | 8/1987 | Kleykamp | 105/377 X |

FOREIGN PATENT DOCUMENTS

| | | | |
|---|---|---|---|
| 900293 | 11/1953 | Fed. Rep. of Germany | 220/323 |
| 439842 | 10/1948 | Italy | 220/323 |

*Primary Examiner*—James B. Marbert
*Assistant Examiner*—Dean Kramer
*Attorney, Agent, or Firm*—Gravely, Lieder & Woodruff

[57] ABSTRACT

A hold down bar for securing adjacent hatch covers of a hopper car and for further sealing the gap that exists between those covers includes a latch arm formed from spring steel in the configuration of an inverted U so as to have a generally straight midportion and legs which are directed downwardly and outwardly from the midportion. In addition, the bar has a resilient shoe which fits against and is attached to the midportion of the latch arm, but is shorter than the space between the two legs so that it can be adjusted back and forth in that space and thus positioned with considerable precision with regard to underlying hatch covers. The shoe in turn carries a gasket that seats against the adjacent hatch covers along a gap between them to effect a water tight seal with those latch covers. Being formed from spring steel, the latch arm will deflect in the presence of heavy impacts, such as derived from the latch covers being dropped on them, but will not take on a permanent deformation. One leg of the latch arm is rolled into a knuckle which receives a bushing sized to fit into the space between two tabs on a hinge bracket located on the roof of the rail car, and this bushing is secured within the knuckle by washers which fit over and are attached to it so that the knuckle is captured between the washers. Thus by varying bushings a single latch arm and likewise the bar of which it forms a part can accommodate various hinge brackets.

24 Claims, 3 Drawing Sheets

HOLD DOWN BAR FOR RAIL CAR HATCH COVERS

BACKGROUND OF THE INVENTION

This invention relates in general to covered hopper cars and more particularly to hold down bars for securing covers that close the hatches on such cars.

Some granular and nodular materials as diversified as grains and cement should not be exposed to moisture, yet because they are commodities, they must be shipped at the least possible expense. The covered hopper cars used on American railroads serve this purpose. This type of car has side and end walls as well as a bottom wall provided with discharge openings which are normally closed by hinged doors. In addition it has a slightly arched roof which is provided with a hatch in the form of an elongated opening that extends substantially the entire length of the roof and walkways located along both sides of the hatch. Several hatch covers, which are hinged to the roof along one side of the hatch, normally cover the hatch, these covers being located in succession along the hatch so that each extends over a portion of the hatch.

The hatch covers carry gaskets which seat against the upper edge of the wall that encloses the hatch so as to exclude contaminants, most notably water, at this location. While gaps exist between the hatch covers themselves, these gaps are closed with so-called hold down bars, which like the hatch covers, are hinged to the roof along one side of the hatch. The bars extend over the closed hatch covers at the gaps and are engaged by latching devices on the other side of the hatch. Additional hold down bars extend over the ends of the hatch covers at the two ends of the hatch. The bars likewise carry gaskets, and these gaskets seat against the hatch covers to each side of every gap so as to prevent contaminants from seeping into the gaps. Just as significantly, the bars hold the hatch covers down and indeed compress the gaskets on the undersides of the covers against the upper margin of the hatch.

Although hatch covers are fabricated from a lightweight material, such as fiberglass or aluminum, they can vary from 8 to 13 feet in length and can weigh in excess of 100 lbs., making them somewhat difficult to open. Moreover, those charged with loading hopper cars do not handle such covers gently. Typically these workmen unlatch the hold down bars, lift them upwardly and then swing them backwardly until they impinge against the car roof or the walkway near their hinge joints. Ordinarily the hold down bars can withstand this abuse. However, the workmen treat the hatch covers similarly, and they fall backwardly against the hold down bars, causing the bars to bend backwardly still farther under the substantial weight of the hatch covers. Indeed, the force of the impacts from the covers is often enough to deform and damage the hinge brackets for the hold down bars and hatch covers, not to speak of the bars themselves and the walkways against which they bear.

Aside from the foregoing, a steel hold down bar in common use has its gasket bonded to it with an adhesive, but the steel of the bar in time rusts which causes the adhesive bond between it and the gasket to deteriorate. If the gasket breaks loose, the sharp edges of the steel cut into the upturned edges on the two hatch covers over which the bar normally extends and damage the ends of those covers, making it necessary to replace the damaged covers and the gasket to again have a serviceable rail car.

Indeed, replacing a gasket on a hold down bar of conventional construction is not a simple matter, for usually the entire bar must be removed and taken to a shop where its gasket is removed and a new one installed in its place. This can be a difficult and costly procedure. Stripping a defective gasket and applying a new one in the field, that is without removing the hold down bar, is even more difficult and costly.

Furthermore, conventional hold down bars are designed to accommodate rail cars of only one design. Thus, a railroad must maintain an inventory of complete bars varied enough to service cars of several designs.

DESCRIPTION OF THE DRAWINGS

In the accompanying drawings which form part of the specification and wherein like numerals and letters refer to like parts wherever they occur

DETAILED DESCRIPTION

Figure 1:
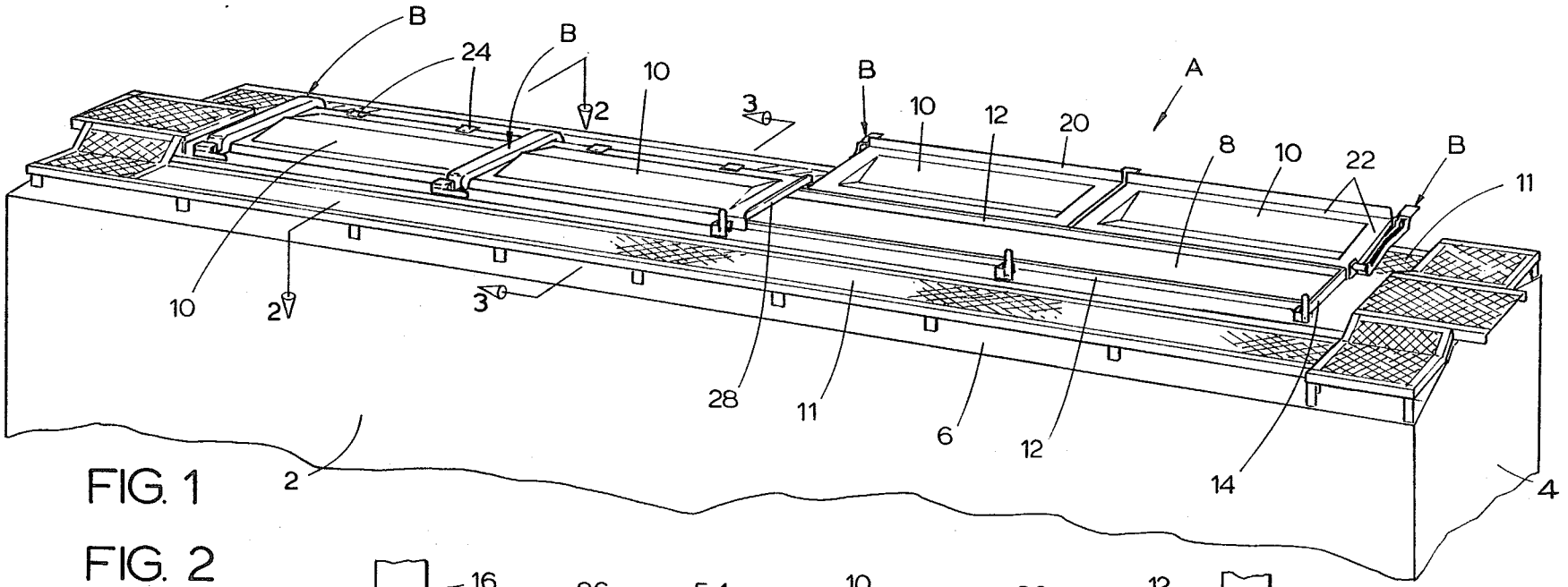
FIG. 1 is a partial perspective view of a hopper-type rail car provided with hold down bars constructed in accordance with and embodying the present invention.

Referring now to the drawings, a covered rail car A (FIG. 1) has side walls 2 and end walls 4, as well as a roof 6 which is connected to the side and end walls 2 and 4 along the upper margins of those walls. The roof 6 contains a single hatch 8 which extends essentially its full length along its longitudinal center line, and this hatch is normally closed by several hatch covers 10 which lie along it, one after the other, in succession. Each cover 10 is hinged with respect to the roof 6 so that it may swing upwardly to expose the hatch. In addition, the roof 6 i fitted with walkways 11 which extend its entire length, one on each side of the hatch 8. The hatch covers 10 are secured in their closed position by hold down bars B which, like the covers themselves, are hinged to the roof 6. The endmost bars B each extend over the transverse or end edge on a single hatch cover 10, whereas the intermediate hold down bars B lap over the end edges of a pair of hatch covers 10, so a single intermediate hold down bar B secures two hatch covers 10.

Figure 3:
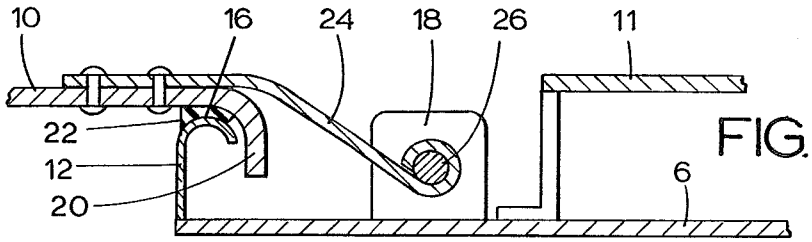
FIG. 3 is a fragmentary sectional view taken along line 3—3 and showing the hinge for a hatch cover.

More specifically, the hatch 8 in the roof 6 of the rail car A, while being along the longitudinal centerline of the roof 6, occupies a relatively small area of the roof 6, it being normally about 20 or 24 in. wide, whereas the car A and its roof 6 are about 10 ft. wide. The hatch 8 is formed by parallel side walls 12 and parallel end walls 14 which project several inches upwardly from the roof 6, above which they are rolled outwardly and downwardly to form curved sealing surfaces 16 (FIG. 4) which together occupy the full periphery of the hatch 8. Along one of the side walls 12 the roof 6 has hinge brackets 18 (FIG. 3) welded to it, with each bracket 18 consisting of a pair of upwardly directed tabs, and it is to these brackets 18 that the hatch covers 10 are connected.

Each hatch cover 10 is molded from fiberglass or stamped or fabricated from aluminum sheet, both relatively lightweight materials. Along its sides the cover 10 has downwardly directed lips 20 (FIG. 4) which, when the cover 10 is closed, lie directly outwardly from the two side walls 12 of the hatch 8. Immediately inwardly from the lips 20, the cover 10 on its underside is fitted with elastomeric gaskets 22 which seat against and form a seal along the sealing surfaces 16 of the two side walls 12 for the hatch 8. Moreover, the gaskets 22 extend transversely across the two hatch covers 10 at the end of the roof 6 where they overlie and seat against the sealing surfaces 16 on the end walls 14 of the hatch 8.

Each hatch cover 10 along one of its sides, indeed along the side at which the hinge brackets 18 are located, is provided with hinge plates 24 (FIG. 3) which project laterally into the spaces between the tabs on the hinge brackets 18 where they are rolled into knuckles to accept hinge pins 26 which are likewise received in the tabs of the hinge brackets 18. The brackets 18, hinge plates 24 and hinge pins 26 create hinges which enable the hatch covers 10 to be swung upwardly over center and then downwardly toward the walkway 11 that is along the hinge brackets 18 so as to expose the hatch 8.

While the covers 10 have downwardly directed lips 20 extended longitudinally along their sides, they have upwardly directed flanges 28 (FIGS. 4 and 5) extended transversely along their ends. The flanges 28 not only stiffen the covers, but also serve to effect a seal with the hold down bars B so as to prevent contaminants from entering the hatch 8 between adjacent hatch covers 10. In this regard, when the hatch covers 10 are closed, a slight gap g will exist between the side-by-side flanges 28 of adjacent hatch covers 10, and unless this gap is sealed, it will serve as an entry for contaminants into the hatch 8, for after all the gaskets 22 only exclude contaminants along the sides and ends of the hatch 8. To accommodate the hold down bars B, the flanges 28 of the hatch covers 8 have straight upper edges 32 which are continuous across substantially the entire width of their respective hatch covers 10, but at their ends have arcuate corners 34 which curve downwardly and merge into the outwardly presented surfaces of the lips 20 with which they are flush.

Figure 2:
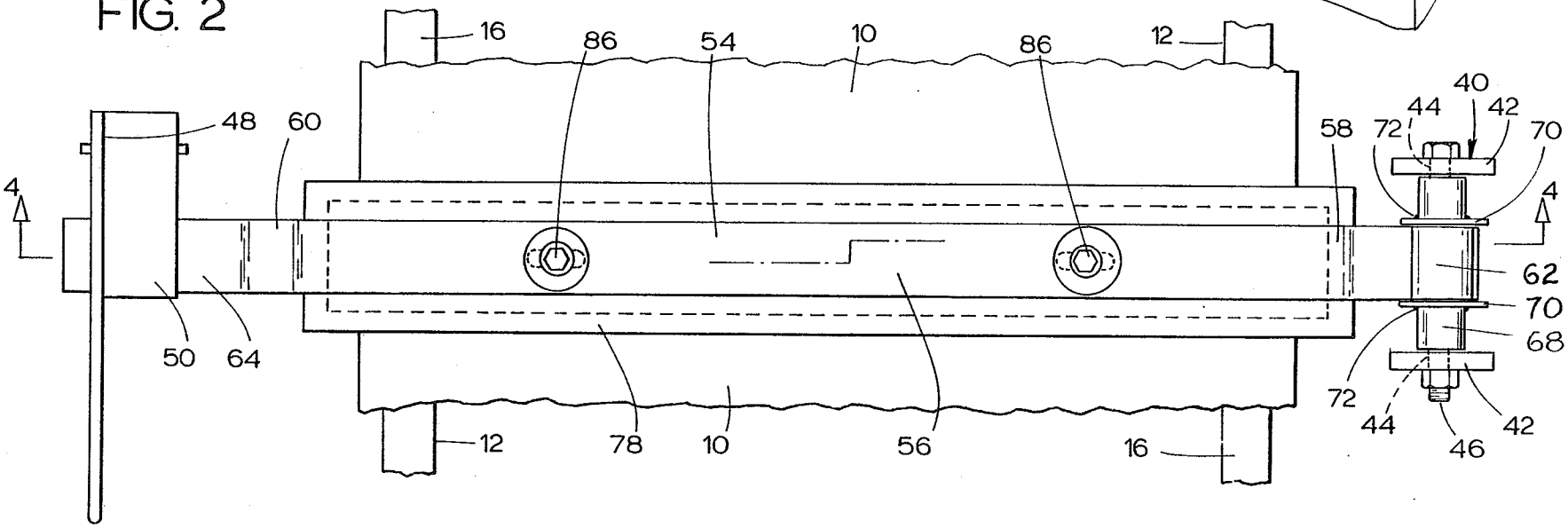
FIG. 2 is a plan view of the hold down bar taken along line 2—2 of FIG. 1.

The hold down bars B, like the hatch covers 10 which they secure, are likewise hinged to the roof 6 of the car A, indeed on the same side of the hatch 8 as are the hatch covers 10. To this end, the roof 6 laterally beyond each gap g and likewise laterally beyond each of the two end walls 14 is provided with additional hinge brackets 40 (FIGS. 2 and 4), each consisting of spaced apart tabs 42 which are welded to the roof 6 and project upwardly from it. The tabs 42 have aligned apertures 44 through which a hinge pin 46 in the form of a bolt extends. On the other side of the hatch 8, the roof 6 is fitted with latch brackets 48, which are likewise located at the gaps g and also at the end walls 14. Each latch bracket 48 projects upwardly from the roof 6 and is fitted with a keeper 50 that swings downwardly to engage the end of one of the hold down bars B. Thus, for every hinge bracket 40 on one side of the hatch 8 a corresponding latch bracket 48 and its keeper 50 exists on the opposite side, so the hinge and latch brackets 40 and 48 are arranged in sets, with each set either being generally aligned with a gap g between hatch covers 10 or with one of the end walls 14 of the hatch 8. A hold down bar B spans the space between the brackets 40 and 48 of each set and in so doing not only secures the hatch covers 10 in their closed positions, but also closes the gaps g so that they do not admit contaminants into the hatch 8.

Figure 4:
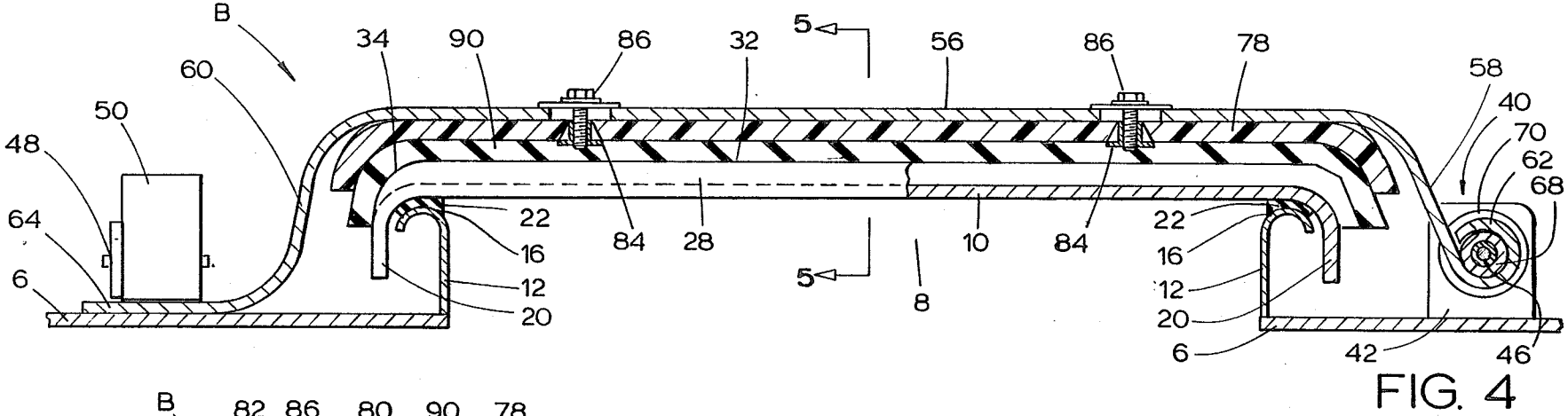
FIG. 4 is a sectional view taken along line 4—4 of FIG. 2 and showing the hold down bar in section.

Each hold down bar B includes a latch arm 54 (FIGS. 6 and 7) which is formed from spring steel generally in the configuration of a shallow inverted U. The arm 54 is of uniform width, and that width is somewhat less than the spacing between the tabs 42 of the hinge brackets 40, so the latch arm 54 at one of its ends will fit between the tabs 42 of a bracket 40. Being of a shallow U-shaped configuration, the latch arm 54 has an elongated midportion 56 and two legs 58 and 60, the latter of which flare slightly outwardly from the former with which they merge at relatively gentle bends. The one leg 58 at its end is rolled into a knuckle 62 which fits between the tabs 42 of the hinge bracket 40 and receives the hinge pin 46. The other leg 60 terminates at an extension 64 which assumes the general orientation of the midportion, but lies outwardly from it, indeed far enough to reach to and fit under the keeper 50 of the latch bracket 48. The midportion 56, on the other hand, is somewhat depressed intermediate its ends, it having a slight camber on the order of about 3/16 in. It further contains a pair of elongated slots 66, the major axes of which are coincident with the longitudinal centerline of the midportion 56. While being somewhat short, the legs 58 and 60 are nevertheless long enough to position the midportion somewhat above the upper edges 32 on the flanges 28 of the hatch covers 10 which the bar B secures, even when the extension 64 on the leg 60 is engaged with the keeper 50 of the latch bracket 48 (FIG. 4).

While the hinge pin 46 extends through the knuckle 62 of the latch arm 54, it does not actually contact the latch arm 54. Instead, the knuckles 62 is fitted with a bushing 68 (FIGS. 2, 4 and 7) which projects out both ends of the knuckle 62 such that the latch arm 54 is centered with respect to it. Indeed, the knuckle 62 is captured in this position between two flat washers 70 which fit over the bushing 68 and against the ends of the knuckle 62, the washers 70 being secured to the bushing at tack welds 72. The length of the bushing 68 is only slightly less than the spacing between the tabs 42 of the hinge bracket 40, and the bushing 68 fits between these tabs, it being confined radially by the hinge pin 46 which passes through the bushing 68 as well as through aligned apertures 44 in the tabs 42. Thus, the latch arm 54 will pivot on the hinge bracket 42 about the axis of the hinge pin 46, but cannot move otherwise with respect to the bracket 40. By selecting the bushings 46 to accommodate the spacing between the tabs 40 of a particular car A, it is possible to utilize the same latch arm 54 on a variety of cars A, that is cars of different manufacturers.

The spring steel from which the latch arm 54 is formed enables the latch arm 54 to withstand considerable abuse without undertaking a permanent deformation. A high carbon chromium alloy steel, such as AISI (American Iron and Steel Institute) 5160-H, that has been heated, quenched in oil and then tempered, is suitable for the latch arm 54. Generally any steel having a yield stress in excess of 180,000 lbs/in$^2$ will suffice.

In addition to the latch arm 54, the hold down bar B has a shoe 78 (FIGS. 5–7) which is molded from a flexible polymer such as urethane and fits between the two legs 58 and 60 of the latch arm 54 where it is against the slightly convex underside of the midportion 56. Indeed, the shoe 78 has an upwardly opening groove 80 which is only slightly wider than the latch arm 54, and this groove 80 receives the midportion 56. The ends of the groove are curved to conform to the curvature of the arm 54 where the legs 58 and 60 merge into the midportion 56, and these curved ends are set somewhat inwardly from the legs 58 and 60 so that the shoe 78 is slightly shorter than the spacing between the legs 58 and 60. As such, the shoe 78 does not inhibit flexure of the arm 54 in the region of its legs 58 and 60, but more importantly space exists for the shoe 78 to be shifted longitudinally with respect to the arm 54 to an optimum position on the arm 54.

The shoe 78 also has a downwardly opening groove 82 (FIG. 5) which extends out into the curved ends of the shoe 78. Embedded within the shoe 78 between its two grooves 80 and 82 are so-called T-nuts 84 (FIGS. 6 and 7), and these nuts align with the slots 66 in the midportion 56 of latch arm 54 when the midportion 56 is received in the upper groove 80. Indeed, the shoe 78 is secured to the latch arm 54 by cap screws 86 which pass through the slots 66 in the midportion 56 of the arm 54 and thread into the embedded T-nuts 84. By reason of the slots 66, it is possible to adjust the shoe 78 longitudinally on the arm 54. Once the proper longitudinal position is achieved, the screws 86 are turned down to secure the shoe 78 in the desired position. It is also possible to adjust the vertical position of the shoe 78 by using shims within the groove 80, between the midportion 56 of the latch arm 54 and the shoe 78.

Figure 5:
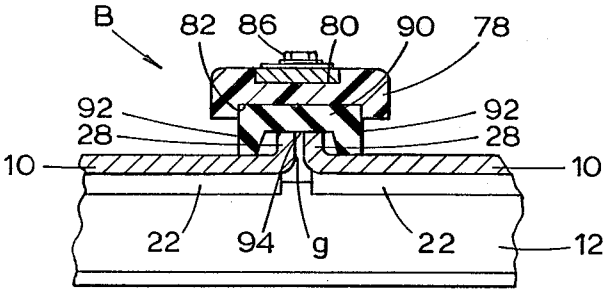
FIG. 5 is a sectional view taken along line 5—5 of FIG. 4 and showing the hold down bar spanning the gap between two adjacent hatch covers.

The shoe 78 carries a gasket 90 (FIGS. 4, 6 and 7) which fits into the lower groove 82 and projects downwardly therefrom, it being attached to the shoe 78 with an adhesive that is between its upper face and the base of the groove 82. The gasket 90, which is formed from an elastomeric material such as neoprene, possesses an inverted U-shaped cross-sectional configuration (FIG. 5) and as such has a pair of downwardly directed legs 92 connected by a bight 94. Both the bight 94 and the legs 92 have flat downwardly presented surfaces which are offset vertically a distance that is approximately equal to the height of the flanges 28 on the hatch covers 10. Moreover, the least spacing between the two legs 92, which is at the bight 94 and indeed is the width of the lower surface on the bight 94, exceeds the space occupied by the two flanges 28 at the ends of adjacent hatch covers 8. Also, the longitudinal contour of the gasket 90, what little there is of it, corresponds to that of the upper edges 32 and curved corners 34 of the side-by-side flanges 28, so that the legs 92 and bight 94 follow the flanges 28 as their upper edges 32 curve into the corners 34 which in turn merge into the outer faces of the downwardly directed lips 20. The arrangement is such that when the gasket 90 is brought down over the gap g between two adjacent covers 10 and properly aligned with those covers, the flat downwardly presented surfaces of legs 92 will bear against the upper surfaces of the two hatch covers 10 adjacent to the respective flanges 26, whereas the flanges 28 themselves will bear against and slightly deform the bight 94, that is to say the edges 32 and 34 on the flanges 28 will bear against the bight 94 of the gasket 90 (FIGS. 4 and 5). To insure that the gasket 90 properly aligns with the two hatch covers 10 over which it extends, it may be adjusted simply by backing of the cap screws 86 and moving the shoe 78 to the proper position, whereupon the screws 86 are again tightened.

The leg 58 on which the knuckle 62 is rolled, is positioned and configured such that when the bar B is lifted upwardly away from the closed hatch covers 10 it normally secures and allowed to drop downwardly, the leg 58 will come against the walkway 11 that runs along the hinge brackets 18 and 40, thus positioning the bar B in a somewhat angulated or oblique position (FIG. 1). Thereafter, when the hatch covers 10 are raised upwardly and allowed to drop overcenter, they will come against the raised bars B, particularly the gaskets 90 on the bars B, instead of against the walkway 11. Since the latch arm 54 is formed from spring steel, it will flex under the impact of the falling cover 10, and thus will absorb that impact without bending and without damage to hinge brackets 18 or 40.

Figure 8:
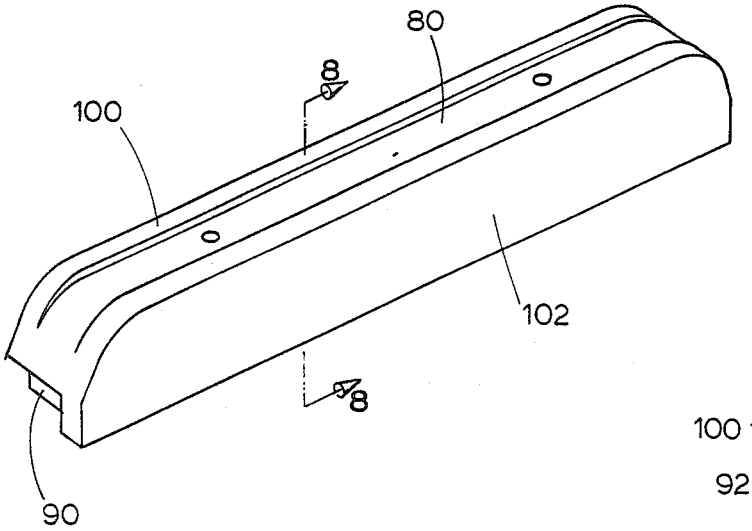
FIG. 8 is a perspective view of a modified shoe for the hold down bar.
Figure 9:
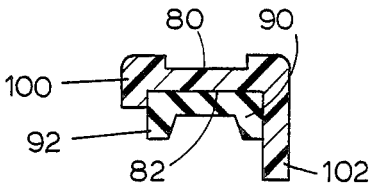
FIG. 9 is a sectional view taken along line 9—9 of FIG. 8.

The hold down bars B at the ends of the hatch 8 have a slightly different shoe 100 (FIGS. 8 and 9) which is similar to the shoe 78 in all respects, except that it has a skirt 102 extending downwardly at one side of its lower groove 82. One side of the gasket 90 is against the skirt 102, and indeed the skirt projects somewhat below the two legs 92. The shoe 100, like the shoe 78, is symmetrical about its midpoint and thus will fit the latch arm 54 with the skirt 102 presented toward either end of the roof 6. This enables the shoes 100 to be installed in the latch arms 54 of the endmost hold down bars B with the skirt 102 of each presented toward the end of the roof 6 at which its hold down bar B is located. In short, the shoes 100 are reversible and may be used in the hold down bars B at either end of the roof 6.

In use, the several hatch covers 10 overlie the hatch 8, one after the other, with their respective gaskets 22 bearing against and producing a seal along the curved sealing surfaces 16 at the upper edges of the hatch walls 12 and 14. For all intents and purposes the seal so formed extends along the full periphery of the hatch 8. However, gaps g exist between the upwardly turned flanges 28 at the ends of adjacent hatch covers 10, but the hold down bars B extend over these gaps, closing them while firmly securing the covers 8 in their closed positions.

Each hold down bar B along the leg 58 of its latch arm 54 is connected to the roof 6 through its hinge bracket 40, whereas its other leg 60 is held down by the corresponding latch bracket 48 inasmuch as the extension 64 on that leg projects beneath the keeper 50 on the bracket 48. The legs 58 and 60, being quite close to the brackets 40 and 48 which secure them, compress the nearby regions of the gasket 90 against hatch cover 10, thus effecting a water-tight seal in those regions. Since the midportion of the latch arm 54 possesses a slight camber, it urges the underlying portion of the gasket 90 downwardly against the hatch covers 10 and thereby maintains the integrity of the seal across the full width of the hatch cover or covers 10 over which it extends. Thus, along each gap g, the gasket 90 of the hold down arm B at that gap g is compressed against the two hatch covers 10 for the full width of those covers 10. Moreover, the gasket 90 contacts each cover 10 at two locations along the latter, namely along the upper and curved edges 32 and 34 of the flange 28 and along the generally horizontal surface from which the flange 28 rises (FIGS. 4 and 5). In other words, the bight 94 of the gasket 90 presses against the edges 32 and 34 of the two flanges 28 between which the gap g exists, whereas the bottom surfaces of the legs 92 bear against the generally horizontal surfaces to the sides of the flanges 28. The result is a highly effective seal along and over the gaps g—one that prevents contaminants, such as water, from seeping into the gap g notwithstanding the substantial windage resulting from movement of the rail car A.

Aside from closing the gaps, the bars B further hold the hatch covers 10 in the closed position, and indeed cause the covers 10 to compress their gaskets 22 against curved sealing surfaces 16 along the side and end walls 12 and 14 for the hatch 8. Indeed, that is the sole function of the hold down bars B at the two ends of the hatch 8, for at these locations no gaps g exist. The skirts 102 on the modified shoes 100 of these hold down bars B extend downwardly past the curved sealing surfaces 16 of the end walls 14, and thus serve to shield the portions of the gaskets 22 that are along the end walls 14.

Of course to load the rail car A with a bulk material of a granular or nodular consistency, the hatch covers 10 must be raised to expose the hatch 8. This is achieved by releasing the keepers 50 of the latch brackets 48 to free the extensions 64 on the latch arms 54 for the several hold down bars B. The hold down bars B are then raised upwardly about the hinge pins 46 at the hinge brackets 40. Indeed, the bars B are raised over center and then allowed to drop downwardly. The bars B come to rest in an oblique open position with the hinge legs 58, bearing against the walkway 11 that extends along the hinge brackets 18 and 40. In this position the soft neoprene gaskets 90 are presented generally upwardly and are supported essentially on the spring steel latch arms 54 which, in turn, at the merger of the hinge leg 58 and midportion 56, bear against the walkway 11 so that the midportion 56 and other leg 60 are cantilevered beyond the walkway 11.

Being displaced to the sides of the hatch 8 and hatch covers 10, the bars B no longer secure the covers 10, and the covers 10 may be lifted upwardly which they are. Each cover 10 as it is lifted pivots about its hinge bracket 40. Once the cover 10 reaches its over center position, it should be lowered gently onto the obliquely disposed hold down bars B.

However, most workmen who attend to the loading of hopper cars are not that careful, and it can be expected that such workmen will merely allow the covers 10 to drop without restraint against the hold down bars B. Being formed from spring steel, the latch arms 54 will flex under the weight of the downwardly swinging hatch covers 10 and thereby absorb much of the impact without bending the hinge brackets 40 or the walkway 11 along those brackets. Since the shoes 78 are formed from a flexible polymer, they flex with the latch arms 54, and of course the gaskets 90 likewise flex. Indeed, the relatively soft gaskets 90 also absorb some of the impact of the falling latch covers 10.

Figure 6:
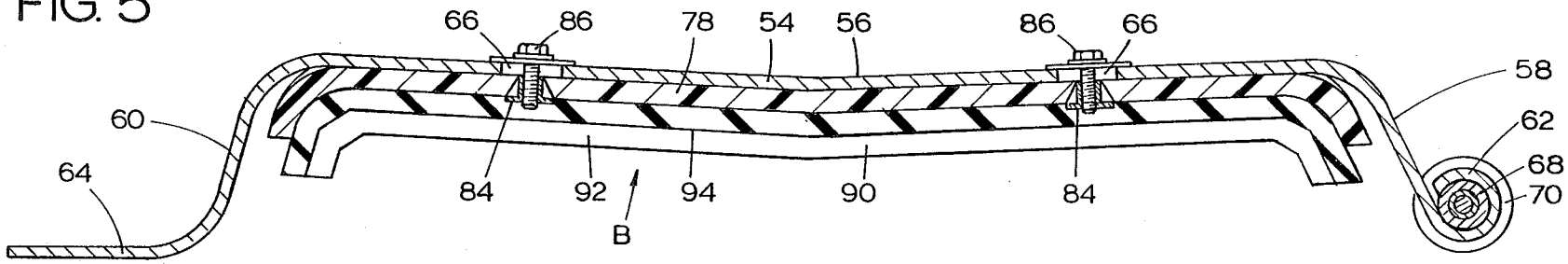
FIG. 6 is a sectional view of the hold down bar in an unrestrained condition.
Figure 7:
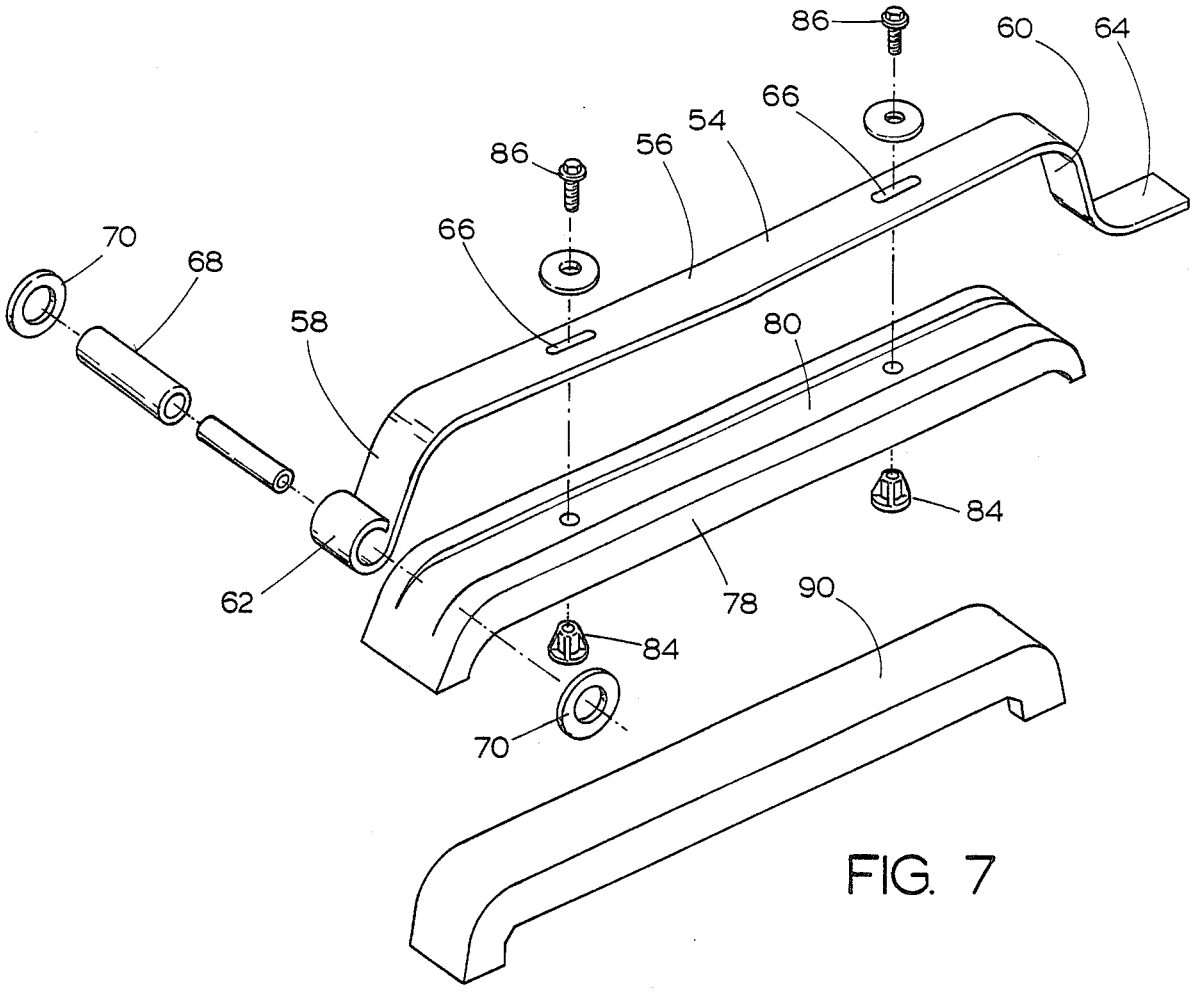
FIG. 7 is an exploded perspective view of the hold down bar.

The hatch 8 is closed through an opposite sequence. In short, the covers 10 are lifted upwardly and lowered onto the walls 12 and 14 of the hatch 8, so that the gaskets 22 of the covers 10 come against the curved sealing surfaces 16 on the hatch walls 12 and 14. Next the hold down bars B are swung upwardly and then downwardly over the hatch covers 10, and indeed each is forced downwardly, whereupon the keeper 50 of the corresponding latch bracket 48 is swung downwardly to engage the extension 64 on the flexible latch arm 54 for that bar B. This of course compresses the gasket 90 against the cover 10 or covers 10 over which the hold down bar B extends. Indeed, as the hold down bar B is brought down toward the cover 10 or covers 10 and is secured with the keeper 50, its latch arm 54 flexes and loses at least some of its camber. As such, the latch arm undergoes a perceptible change in configuration (FIGS. 4 and 6).

Should the gasket 90 of any hold down bar B become damaged or ineffective, it is easily replaced merely by loosening and removing the cap screws 86 which hold the shoe 78 for that gasket 90 to the latch arm 54. The entire shoe 78 and its gasket 90 are discarded and replaced with another shoe 78 containing a new gasket 90—all without removing the latch arm 54 from its hinge bracket 40. The slots 66 in the latch arm 54 enable the shoe 78 and the gasket 90 to be moved to the proper position with respect to the flange 28 or flanges 28 along which it extends, and the amount of compression that the gasket 90 undergoes may be controlled by inserting shims into the upper groove 80 of the shoe 78 so that those shims are located between the midportion 56 of the latch arm 54 and shoe 78. Once the proper longitudinal position is achieved and the appropriate shims are installed, the cap screws 86 are tightened to firmly secure the replacement shoe 78 and its gasket 90 on the latch arm 54.

Since the latch arm 54 is formed from spring steel, it will flex in the presence of severe impacts instead of deforming, and hence the latch arms 54 of the bars B will rarely need to be replaced. When such a replacement is required, the hinge pin 26 for the defective arm is at one end cut off and then with a drift the entire pin 26 is driven from the hinge bracket 40 and the bushing 68 through which it extends. This frees the latch arm 54 so that it may be removed along with the shoe 78 that is attached to it. A replacement latch arm 54 is selected from an inventory and fitted with a bushing 68 appropriate for the spacing between the tabs 42 of the hinge bracket 40 to which it is to be fitted, and this bushing is secured in the knuckle 62 of the latch arm 54 by the two washers 70 which fit on it at each end of the knuckle 62 and are fastened to the bushing 68 by tack welds 72. Thus, it is possible to adapt the hold down bar B to a wide variety of hinge brackets 40, and this simplifies inventory control.

Since the shoe 78 is formed from a polymer, it will not rust and adversely affect the adhesive bond between it and the gasket 90.

This invention is intended to cover all changes and modifications of the example of the invention herein chosen for purposes of the disclosure which do not constitute departures from the spirit and scope of the invention.

What is claimed is:

1. In combination with a car roof having a hatch in it and at least two covers which are capable of fitting over the hatch with their ends adjacent such that a slight gap exists between the adjacent ends, an improved hold down bar for securing the covers to the roof at their adjacent ends and for further closing the gap between such covers so that the gap will not admit contaminants, said hold down bar comprising: a latch arm which at one end is pivotally connected to the roof on one side of the hatch and at its other end is adapted to be fastened to the roof on the other side of the hatch, the latch arm being formed from a resilient material and being substantially flat in cross-section intermediate its ends so that it is capable of flexing easily intermediate its ends; a shoe attached to the latch arm and being formed from a resilient material which enables it to flex with the arm; and gasket attached to the shoe and being configured to generally conform to the upper surface of the hatch covers at the adjacent ends of those hatch covers, the latch arm being configured such that it flexes easily against the natural resiliency of the material from which it is formed and undergoes a perceptible change in shape as its other end is brought down toward and fastened to the roof with the shoe and gasket interposed between the arm and the covers.

2. The combination according to claim 1 wherein the shoe is detachable from the latch arm.

3. The combination according to claim 1 wherein the shoe is attached to the latch arm with screws which permit the shoe and the gasket carried by it to be detached from the latch arms.

4. The combination according to claim 1 wherein the latch arm is of an inverted U-shape, it having a midportion that extends generally along the gap and downwardly directed legs, one of the legs being pivotally connected to the roof and the other being adapted to be fastened to the roof; and wherein the shoe is attached to the latch arm along the midportion and between the legs of the latch arm.

5. The combination according to claim 4 wherein the shoe is shorter than the distance between the legs of the latch arm, and is attached to the midportion such that its position between the legs may be adjusted.

6. The combination according to claim 4 wherein the midportion of the latch arm has a camber which tends to cause its center to be presented somewhat lower than its ends when the latch arm is unrestrained.

7. The combination according to claim 4 wherein the one leg of the latch arm which is pivotally connected to the roof has a knuckle at its end, and further comprising a bushing extending through the knuckle and washers attached to the bushing on each side of the knuckle such that the knuckle is captured between the washers.

8. The combination according to claim 7 wherein the roof along one side of the hatch is provided with a pair of tabs, and wherein the bushing in the knuckle of the latch arm fits between the tabs and a pin extends through the tabs and the bushing to pivotally connect the latch arm to the roof.

9. A hold down bar for securing a hatch cover over a hatch in the roof of a rail car; said hold down bar comprising: a latch arm in the configuration of an inverted U so as to have a midportion and downwardly directed legs at the ends of the midportion, one of the legs having a hinge knuckle formed on it and the other leg being configured to engage a latching device on the roof of the car, the latch arm being formed from spring steel and otherwise being of a cross-sectional configuration which enables it to easily flex without undergoing a permanent deformation; a shoe attached to the midportion of the latch arm and being located between the legs of the midportion, the shoe being formed from a resilient material so that it will flex with the latch arm; and an elastomeric gasket attached to the shoe and being configured to seat against a hatch cover, the midportion of the latch arm being configured such that when the legs of the latch arm are unrestrained, the midportion of the latch arm possesses a slight curvature as does the shoe and the gasket, so that the gasket assumes a somewhat convex shape intermediate its ends on its downwardly presented surface.

10. A hold down bar according to claim 9 wherein the length of the shoe is less than the distance between the two legs of the latch arm; and wherein the shoe is attached to the midportion of the latch arm such that it may be adjusted longitudinally of the latch arm in the space between the legs of the latch arm.

11. A hold down bar according to claim 9 wherein the shoe on one of its sides terminates above the gasket and on its other side is provided with a skirt which projects downwardly below the gasket.

12. A hold down bar according to claim 9 and further comprising a bushing extending through the knuckle on the one leg of the latch arm and projecting beyond both ends of the knuckle and washers attached to the bushing at each end of the knuckle so that the knuckle is captured between the washers.

13. In combination with a car roof having a hatch in it and at least two covers which are capable of fitting over the hatch with their ends adjacent such that a slight gap exists between the adjacent ends, an improved hold down bar for securing the covers to the roof at their adjacent ends and for further closing the gap between such covers so that the gap will not admit contaminants, said hold down bar comprising: a latch arm of inverted U-shape, it having a midportion that extends generally along the gap and downwardly directed legs, the latch arm at one of the legs being pivotally connected to the roof on one side of the hatch and at the other leg being adapted to be fastened to the roof on the other side of the hatch, the latch arm being formed from a resilient material that is capable of flexing; a shoe attached to the latch arm along the midportion of the arm between the legs of the arm, the shoe being shorter than the distance between the legs of the arm and the attachment being such that the position of the shoe between the legs may be adjusted, the shoe being formed from a resilient material which enables it to flex with the latch arm; and a gasket attached to the shoe and being configured to generally conform to the upper surface of the hatch covers at the adjacent ends of those hatch covers.

14. The combination according to claim 13 wherein the midportion of the latch arm contains at least one slot, the longitudinal axis of which is parallel to the longitudinal axis of the midportion; and wherein a screw passes through the slot and into the shoe and when tightened down secures the shoe in the desired position on the latch arm.

15. The combination according to claim 14 wherein the shoe has a nut embedded in it and the screw is a cap screw which passes through the slot and threads into the nut in the shoe.

16. The combination according to claim 14 wherein the shoe has an upwardly opening groove and the midportion of the latch arm is received in that groove.

17. The combination according to claim 16 wherein the midportion of the latch arm has a camber which presents its center somewhat lower than its ends when the latch arm is unrestrained.

18. The combination according to claim 16 wherein the shoe also has a downwardly opening groove and the gasket fits into the groove and projects downwardly out of it.

19. A hold down bar for securing a hatch cover over a hatch in the roof of a rail car; said hold down bar comprising: a latch arm in the configuration of an inverted U so as to have a midportion, downwardly directed legs at the ends of the midportion, one of the legs having a hinge knuckle formed on it and the other leg being configured to engage a latching device on the roof of the car, the latch arm being formed from a resilient material so that it may flex without undergoing a permanent deformation; a shoe attached to the midportion of the latch arm and being located between the legs of the midportion, the length of the shoe being less than the distance between the two legs of the latch arm and the shoe being attached to the midportion of the latch arm such that it may be adjusted longitudinally of the latch arm in the space between the legs of the latch arm, the shoe being formed from a resilient material so that it will flex with the latch arm; and an elastomeric gasket attached to the shoe and being configured to seat against a hatch cover.

20. A hold down bar according to claim 19 wherein the shoe contains an upwardly opening groove in which the midportion of the latch arm is received.

21. A hold down bar according to claim 19 wherein the midportion of the latch arm contains at least one slot, the major axis of which is generally parallel to the longitudinal axis of the midportion, and wherein a screw extends through the slot and into the shoe to attach the shoe to the latch arm.

22. A hold down bar according to claim 21 wherein the shoe also has a downwardly opening groove in which the gasket is received.

23. In combination with a car roof having a hatch in it and at least two covers which are capable of fitting over the hatch with their ends adjacent such that a slight gap exists between the adjacent ends, the covers being hinged with respect to the roof along one side of the hatch, so as to expose the hatch when the covers are raised over center and then allowed to drop downwardly, an improved hold down bar for securing the covers to the roof at their adjacent ends and for further closing the gap between such covers so that the gap will not admit contaminants, said hold down bar comprising: a latch arm having a raised midportion that is long enough to extend across the covers at the gap and legs at each end of the midportion, the latch arm at one leg being pivotally connected to the roof on the side of the hatch at which the covers are hinged and at its other end being adapted to be fastened to the roof on the other side of the hatch, the latch arm being formed from spring steel and within at least its midportion being of a cross-section that enables it to easily flex, a shoe attached to the latch arm along the midportion thereof and being formed from a resilient material which enables it to flex with the arm; and a gasket attached to the shoe and being configured to generally conform to the upper surface of the hatch covers at the adjacent ends of those hatch covers, whereby the hold down bar can be swung upwardly about the pivotal connection of its latch arm away from the hatch and cover to an over center position and thence downwardly to an open position in which the gasket is presented upwardly, the resiliency of the latch arm, shoe and gasket being such that when a cover is raised over center and allowed to drop downwardly without restraint onto the hold down bar, the latch arm, shoe and gasket will all flex without undergoing a permanent deformation.

24. The combination according to claim 23 wherein the latch arm possesses a flat cross-section in its legs as well as through its midportion; and wherein the midportion of the latch arm possesses a slight camber when unrestrained, but the camber is substantially eliminated when the hold down bar extends over the covers and the other end of its latch arm is fastened to the roof.

* * * * *